US006023802A

United States Patent [19]

King

[11] Patent Number: 6,023,802

[45] Date of Patent: Feb. 15, 2000

[54] INFANT SLEEPER

[76] Inventor: Susan Melton King, 586 CR 1101, Booneville, Miss. 38829

[21] Appl. No.: 08/926,477

[22] Filed: Sep. 10, 1997

[51] Int. Cl.[7] ..... A47C 27/14; A47G 9/00; A47D 13/00

[52] U.S. Cl. ..... 5/655; 5/732

[58] Field of Search ..... 5/655, 732, 630, 5/632, 94; D6/601

[56] References Cited

U.S. PATENT DOCUMENTS

| | | | |
|---|---|---|---|
| D. 259,458 | 6/1981 | Fuller et al. | 5/655 |
| 279,134 | 6/1883 | Comins . | |
| D. 333,389 | 2/1993 | Saito et al. . | |
| D. 339,556 | 9/1993 | Berglund . | |
| D. 353,494 | 12/1994 | Beger . | |
| 2,401,605 | 6/1946 | Boren . | |
| 2,475,775 | 7/1949 | Boren . | |
| 3,004,793 | 10/1961 | Loomis . | |
| 3,383,718 | 5/1968 | Spencer . | |
| 3,466,678 | 9/1969 | Glaser et al. . | |
| 3,854,156 | 12/1974 | Williams . | |
| 4,471,767 | 9/1984 | Guimond . | |
| 4,566,449 | 1/1986 | Smith | 5/655 |
| 4,648,142 | 3/1987 | Bruning . | |
| 4,790,041 | 12/1988 | Shtull | 5/655 |
| 5,127,120 | 7/1992 | Mason | 5/655 |
| 5,127,422 | 7/1992 | Colon . | |
| 5,367,730 | 11/1994 | Sher | 5/732 |
| 5,387,177 | 2/1995 | Dunn | 5/655 |
| 5,440,770 | 8/1995 | Nichols . | |
| 5,448,790 | 9/1995 | Saro et al. | 5/732 |
| 5,524,640 | 6/1996 | Lisak et al. | 5/655 |
| 5,561,879 | 10/1996 | Everall | 5/655 |
| 5,718,011 | 2/1998 | Nogues | 5/655 |

FOREIGN PATENT DOCUMENTS

| | | |
|---|---|---|
| 1083811 | 9/1964 | United Kingdom . |
| 2283168 | 1/1994 | United Kingdom . |

*Primary Examiner*—Alex Grosz
*Attorney, Agent, or Firm*—Antton & Associates P.C.

[57] ABSTRACT

An infant sleeper is provided that has raised wall portions positioned to approximately correspond to the center of mass of the infant so as to provide maximum retention support and security to the infant. The raised wall portions, in combination with a horizontal surface on which the infant rests, secures the infant to the bed. The head can be inclined at an angle so that the head of the infant can be kept slightly above its foot. The portion of the bed that lacks the raised wall portion provides as little obstruction as possible to the head of the infant so as to reduce potential feelings of claustrophobia as well as possible obstructions to breathing such as from blankets. Hence, the present invention combines a secure place for an infant to sleep with a sense of openness and freedom. It is believed that this position allows the infant to rest in a more correct anatomical position so as to ameliorate potential respiratory conditions and especially sudden infant death syndrome (SIDS).

11 Claims, 6 Drawing Sheets

INFANT SLEEPER

BACKGROUND AND SUMMARY OF THE INVENTION

The present invention relates to an infant sleeper, cradle, crib or the like.

Sudden infant death syndrome (SIDS) is a medical condition in which a new born suffocates because he or she literally "forgets" to breathe. The nervous systems of newborns are often not sufficiently developed to deal with the stress associated with breathing.

The causes of sudden infant death syndrome are not fully known. However, it is known that sudden infant death syndrome occurs most often when the infant is asleep. Further, studies have shown that SIDS most often occurs while the infant is sleeping on his or her stomach. These studies suggest that instances of SIDS might be reduced, perhaps by as much as one half, by preventing the infant from sleeping on his or her stomach.

Infant sleepers are well known in the art. Such infant sleepers often take the shape of a crib, bassinet or the like such as shown in, for example, U.S. Pat. Nos. 274,467, 279,134, 2,401,605, 2,475,775, 3,383,718 and 3,466,678. These types of cribs typically have a raised side wall at the head of the bed that drops away at least part way going toward the foot of the bed. They do not raise the head of the infant at all.

It is reasonable to assume that an infant sleeper needs to create a warm, secure place for an infant to sleep, as well as to allow others, such as the child's parents, to easily access the infant. The goals of security and easy access conflict. However, this conflict has not traditionally been resolved by including considerations of the much more serious importance of minimizing the possibility of sudden infant death syndrome.

One of the common infant sleepers in use is the so-called bassinet configuration. This sleeper encloses the infant in what is essentially a crib. The sides of the bassinet are generally at least partially transparent so as to allow the infant to be viewed while sleeping. The walls of the sleeper are made high enough to keep the infant secure. It is also important that the walls be made low enough to permit easy access to the infant. This objective can be achieved by creating a lowered portion at the infant's foot to allow for easier access.

The design of an infant sleeper also has a psychological effect on the infant. It is known that an infant may be reluctant to sleep in a crib that is too small or perceived to be too confining. Shallow walls seem to provide a more pleasing psychological sleeping space. However, shallow walls may allow an infant to fall out of the sleeper. The possibility of an infant falling out quickly becomes more pronounced as the infant grows.

There is a need in the art for an infant sleeper that creates a warm, secure sleeping space for the infant while also providing a safe, secure and psychologically pleasing space for the infant. There is a need in the art for an infant sleeper that relieves stress on the infants's neck, shoulder and arm without restricting the infant's natural movements. And there is a need in the art for an infant sleeper that provides both easy access to the infant and a secure sleeping space while also accounting for the potentially profound effects that posture can have on the infant's ability to breathe.

These and other objectives are achieved with an infant sleeper that is designed to hold the infant in a horizontal surface inside the raised wall portions. The head of the infant can come to rest on a portion of the bed that can be made open through the lack of the raised wall portions. The raised wall portions secure the infant in place. The infant can be further secured to the bed using one or more straps, optionally covered with a fastening material, for example, VELCRO®, that is positioned to come over the infant's mid-section.

The raised wall portions can correspond approximately to the center of mass of the infant so as to provide maximum retention support and security to the infant. The raised wall portions, in combination with the horizontal surface, secures the infant to the bed. The retention straps supplement this restraint. Also, the portion of the bed that lacks the raised wall portion provides as little obstruction as possible to the head of the infant so as to reduce potential feelings of claustrophobia. Hence, the present invention combines a secure place for an infant to sleep with a sense of openness and freedom.

More particularly, the present invention comprises an infant sleeper having a contour trough having a head end and a foot end, two parallel raised side walls, each raised side wall having a front end, a mid section and a back end, the raised side walls contacting the contour trough and having a height sufficient to prevent the infant from readily rolling over, a horizontal surface extending a first distance between each raised side surfaces and a second distance between the head end and back end of the contour trough, the dimensions of the first distance being slightly greater than the lateral dimensions of an infant, and the second distance being greater than the length of an infant. The present invention can also advantageously include each raised side wall having a tapered portion extending forward from the mid section toward the head end and progressively lowering toward the head end such that each back end of each side wall is higher in elevation than each front end, and the horizontal surface can have a curvature that is negative between the raised side walls.

All of the foregoing objectives, features and advantages of the present invention, and more, are explained below with the aid of the following illustrative figures and exemplary embodiments.

DETAILED DESCRIPTION

Figure 1:
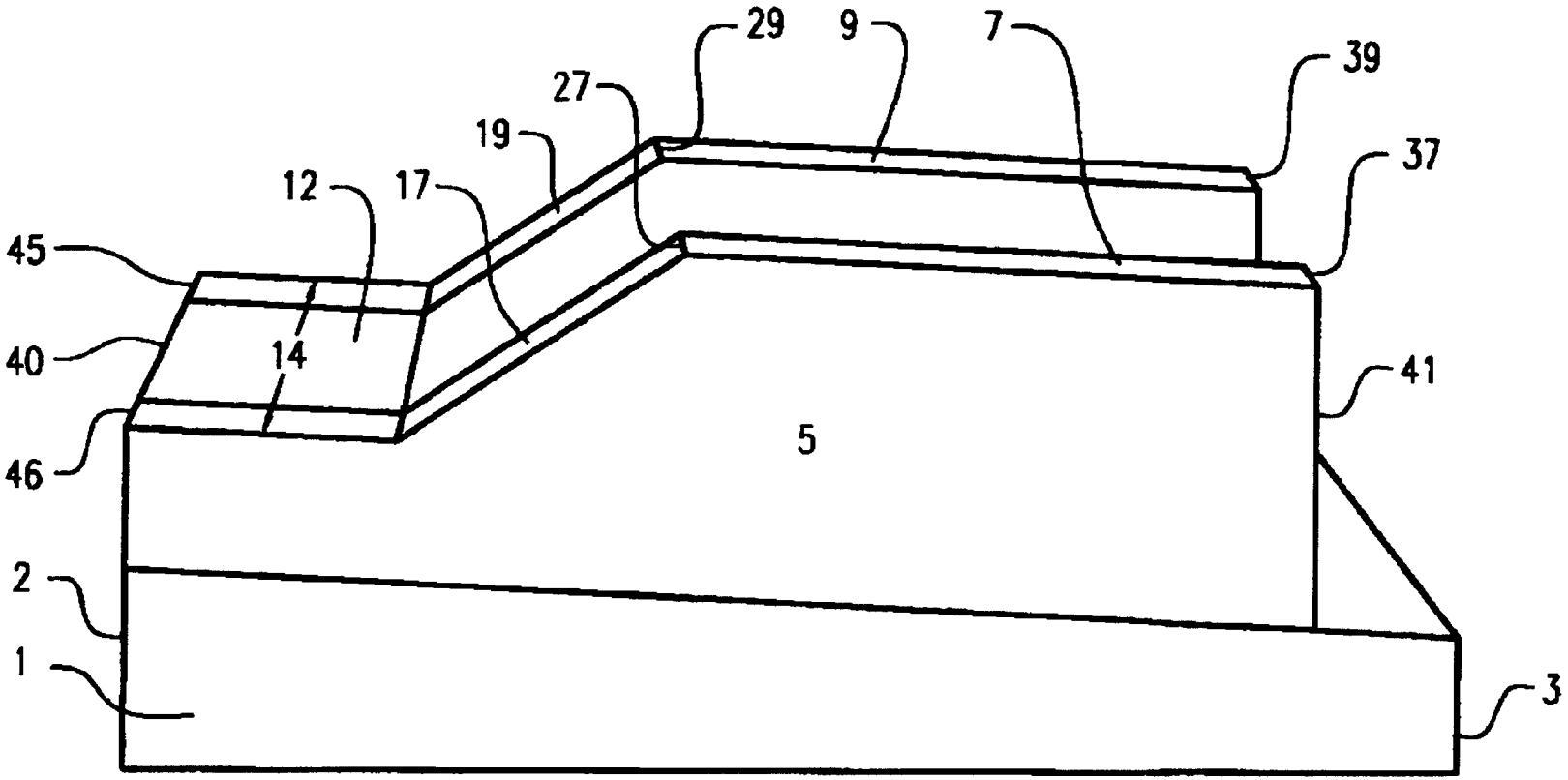
FIG. 1 is a side view of an infant sleeper according to the present invention.

Referring to FIG. 1, the infant sleeper comprises a base 1 made from high compression urethane foam. The base is formed in a wedge shape as shown, with the base head end 2 being elevated above the base foot end 3. The elevation of the infant's head is believed to have advantage in promoting sleep and in reducing stress on the infant.

Figure 2:
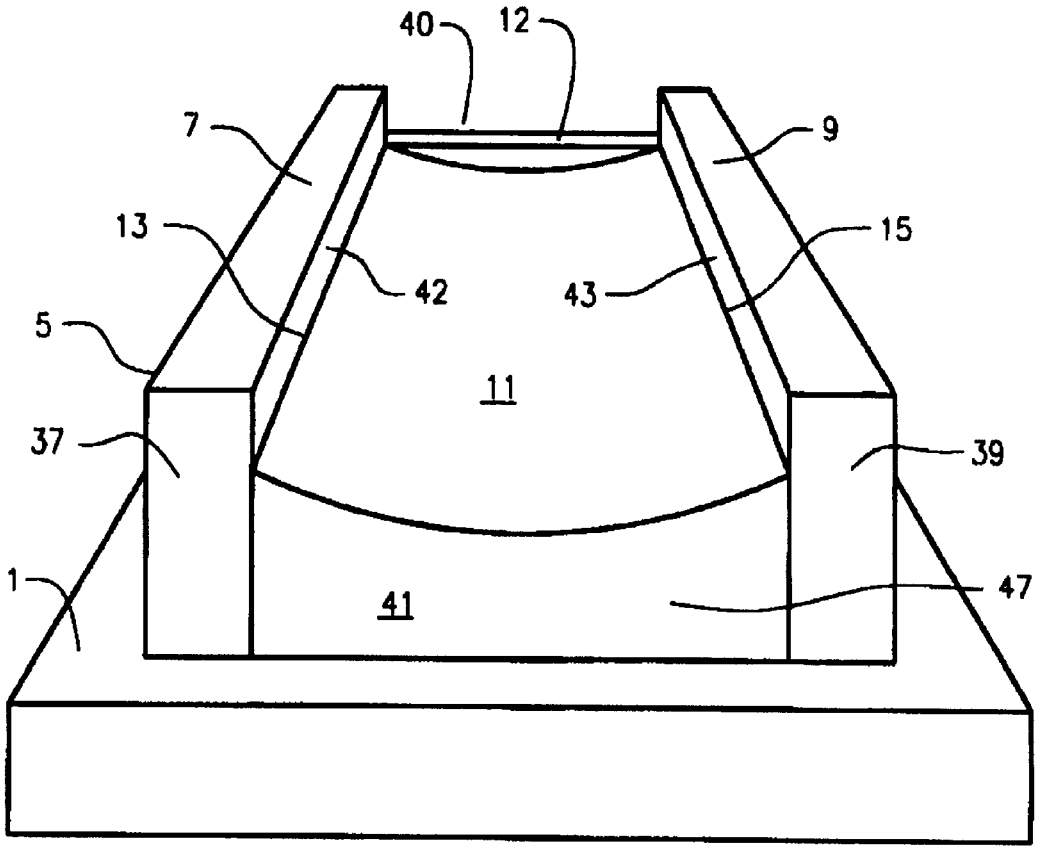
FIG. 2 is an end view of the infant sleeper according to the present invention.

A contour trough 5 is attached to the base 1. The contour trough 5 can be made from low compression urethane foam. As shown in FIGS. 1 and 2, the contour trough 5 can be made from a single piece of material, such as low compression urethane foam, such as to facilitate easy manufacture.

FIG. 2 shows the profile of contour trough 5. The contour trough 5 includes a support member 47 with two parallel raised side walls 7, 9 on each side of the support member, a trough head end 40, a trough foot end 41, and a horizontal surface 11 which comprises the upper surface of support member 47. As shown in FIG. 2, the contour of horizontal surface 11 has a negative, meniscus curvature. The horizontal surface 11 contacts and may be bonded to or integral with raised wall inner surfaces 42, 43 of raised side walls 7, 9 along seams 13, 15. The raised side walls 7, 9 have a height that is great enough to prevent an infant laying on the horizontal surface 11 from readily rolling over either raised side wall. The width of the horizontal surface 11 between the raised side walls 7, 9 is slightly greater than the width of an infant (to allow for adding bedding, blankets and the like). This dimensioning of the horizontal surface 11 is such as to prevent the infant from rolling over onto his or her stomach. It is to be appreciated that the effect of the negative, meniscus curvature can be achieved in other ways. For example, blankets can be spread over the horizontal surface 11; the natural tendency of the blankets to bunch up at the seams 13, 15 will tend to produce a concave curved surface on which the infant can lay that is also suitable for preventing the infant from rolling over onto his or her stomach.

The raised side walls 7, 9 are tapered in regions 17, 19 as shown in FIG. 1. This taper extends from regions 27, 29 to the head piece 12 at the trough head end 40 and is about half the height of the contour trough 5 at regions 27, 29. The tapered regions 17, 19 serve to open up the head end 40 of the infant sleeper. In this way, an infant placed on the horizontal surface 11 in the contour trough 5 can have its head extend into the open area at the head end 40. This openness is thought to reduce feelings of claustrophobia and thus enable the infant to spend extended amounts of time in the infant sleeper.

The contour trough 5 is shown as providing open access to the horizontal surface 11 at the trough foot end 41 of the contour trough 5. The raised sides 7, 9 end at the foot end 41 at surfaces 37, 39 as shown in FIGS. 1 and 2. This open construction provides easier access to an infant lying in the contour trough 5 and provides the infant with a feeling of openness. Moreover, the open construction serves to prevent obstructions, such as blankets, from possibly obstructing the infant's breathing.

As shown in FIGS. 1 and 2, the horizontal surface 11 extends from the trough foot end 41 of contour trough 5 through to the trough head end 40. The head piece 12 is inserted on top of the contour trough 5 so as to provide a head rest for the infant.

Figure 4:
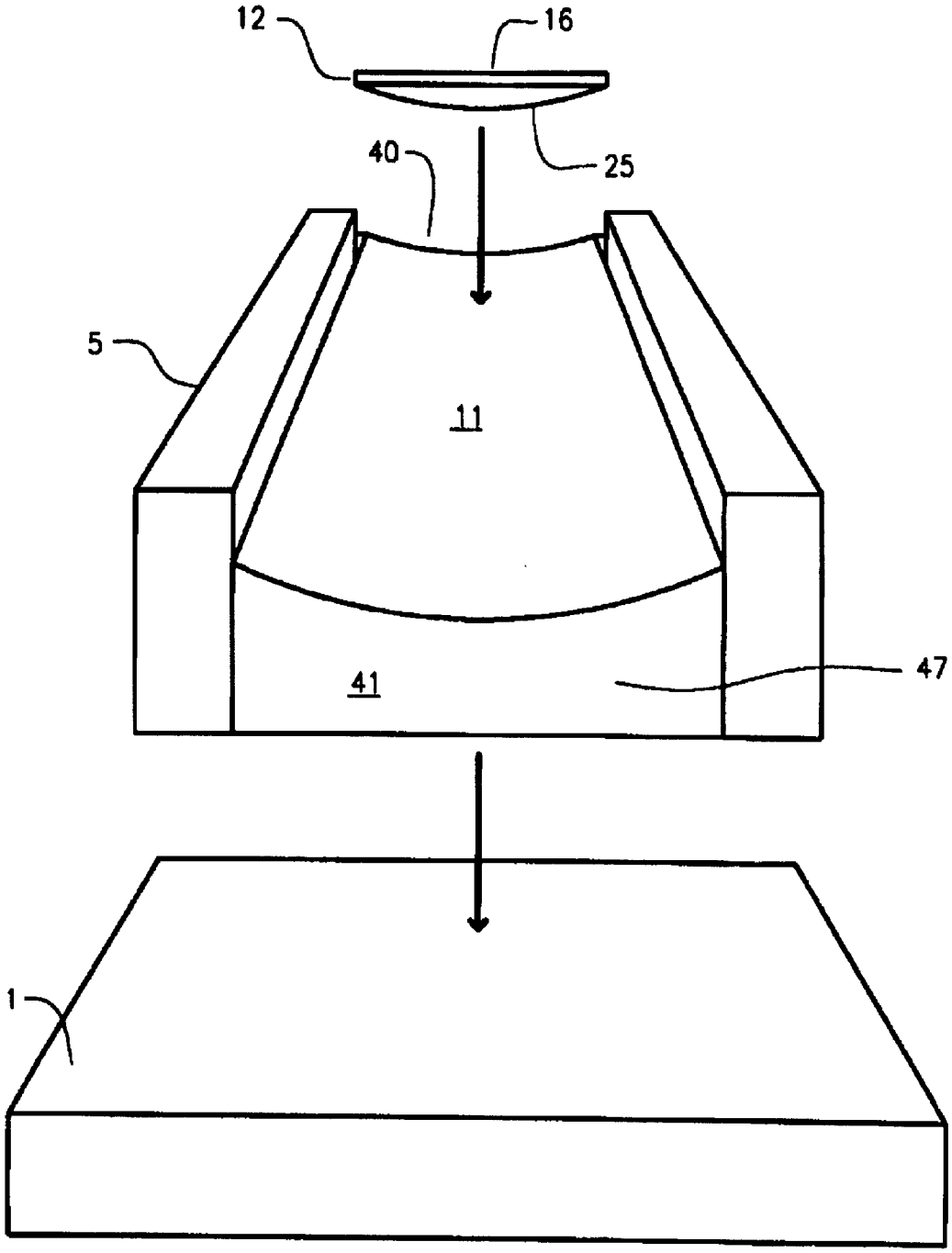
FIG. 4 is an exploded view of the infant sleeper from the perspective shown in FIG. 2.

As shown in FIG. 4, the head piece 12 has an upper side 16 that is flat and a lower side 25 that has a curvature which is approximately the same as the curvature of the horizontal surface 11 shown in the figures but opposite in sign. The resulting positive, convex curvature of surface 25 approximates the curvature of the horizontal surface 11. In this way, the head rest 12 creates a flat region 14 at the trough head end 40 of the contour trough 5 as shown in FIG. 1. The head rest provides a place for the infant to place its head comfortably.

Figure 3:
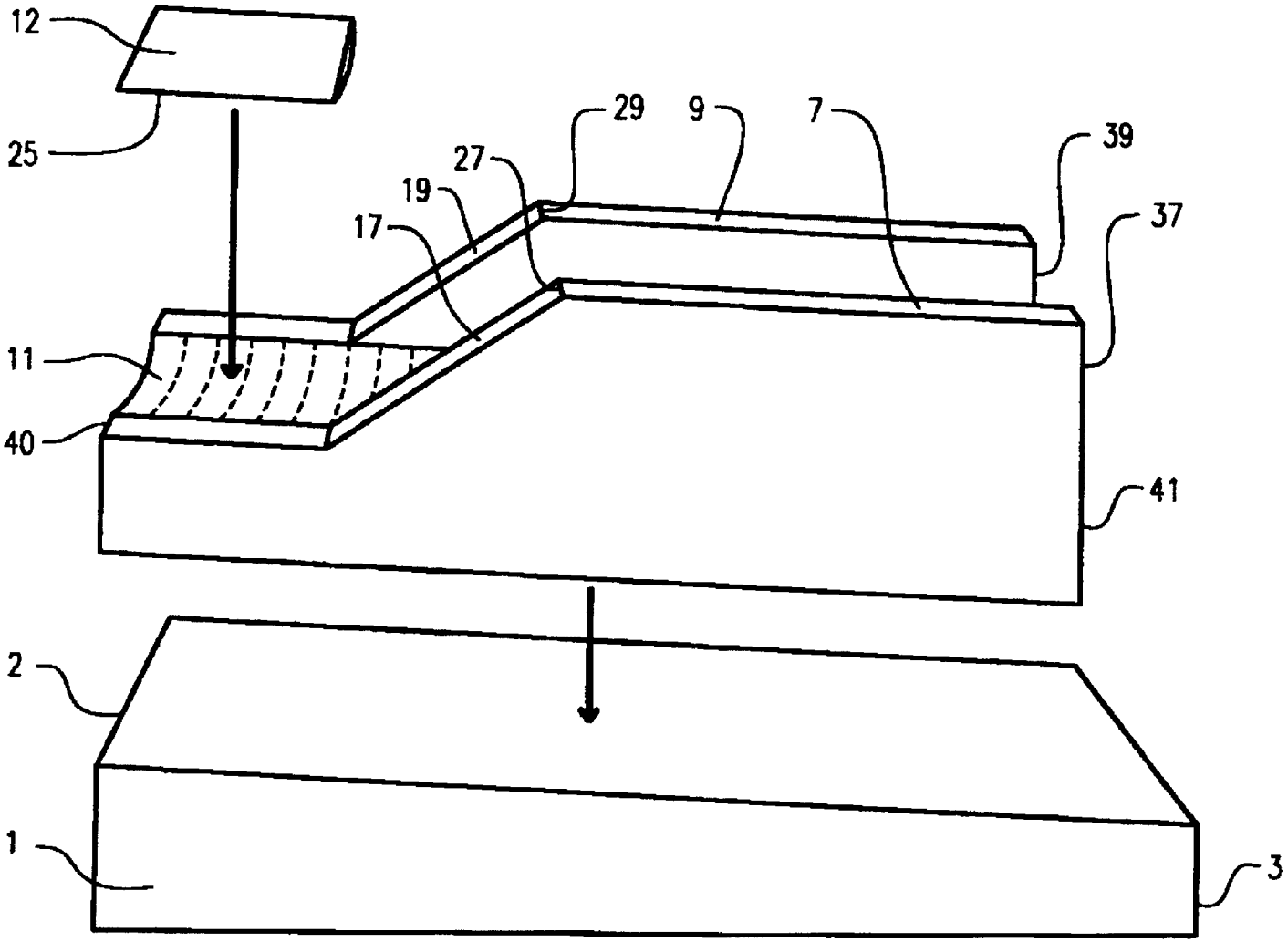
FIG. 3 is an exploded view of the infant sleeper from the perspective shown in FIG. 1.

FIGS. 3 and 4 show exploded views of the infant sleeper shown in FIGS. 1 and 2, respectively.

In FIG. 3, the horizontal surface 11 is shown extending through to the trough head end 40 of the contour trough 5. The lower side 25 of head piece 12 is shown to have a curvature matching that of the horizontal surface 11. The head piece 12 may be permanently mounted into the horizontal surface 11, but a removable head piece is obviously easier to change as needed. As shown in FIGS. 3 and 4, the contour trough 5 can be mounted to the base 1 in any suitable manner, such as gluing. Alternately, the contour trough 5 can simply be laid on the base 1 so that it can be removed and moved as needed.

The infant sleeper shown in FIGS. 1–4 has several advantages over conventional crib or bassinet arrangements. As shown above, the infant sleeper can be moved to any safe location such as inside a conventional crib or bassinet. In addition, the infant sleeper can be safely positioned on a couch, table, parents'bed or in any work area occupied by the parent or care giver. The secure arrangement of the infant sleeper enables the child to be moved without being disturbed.

Figure 5:
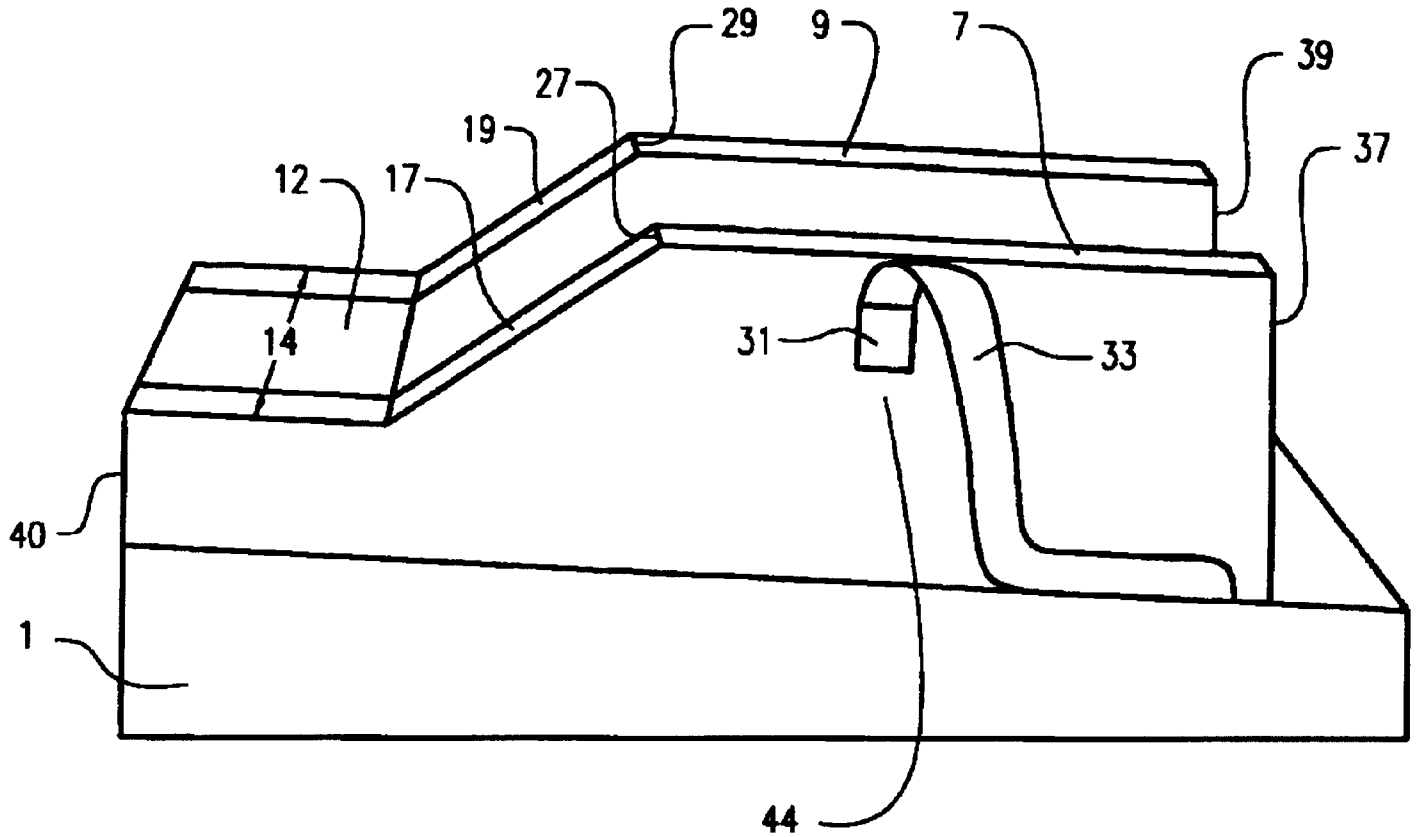
FIG. 5 is a side view of the infant sleeper shown in FIG. 1 further including a retaining strap for securing the infant.
Figure 6:
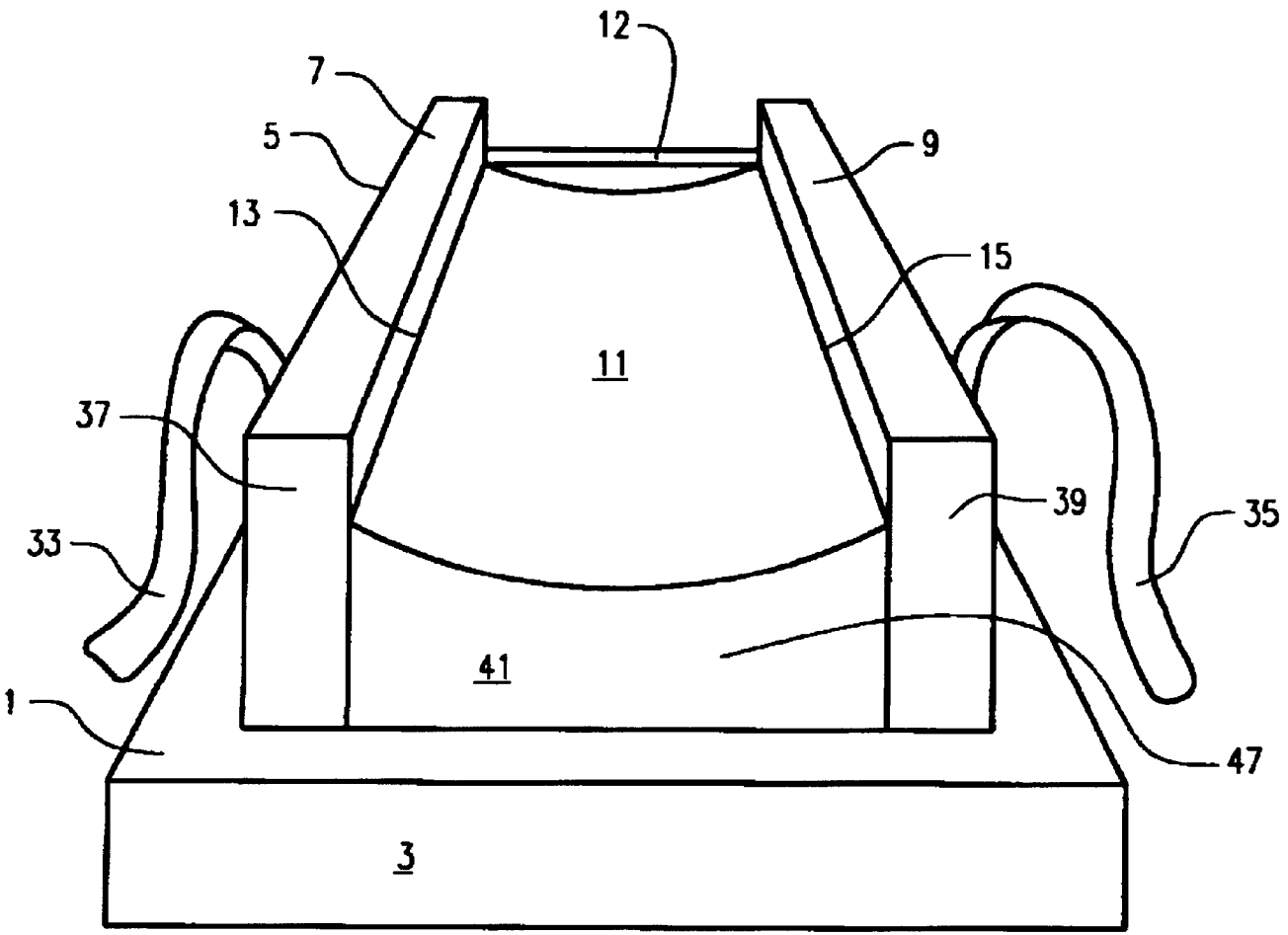
FIG. 6 is an end view of the infant sleeper shown in FIG. 5.

The infant can be made even more secure in the sleeper by securing the infant through the use of straps over the top of the raised side walls 7 and 9. FIG. 5 shows such a strap 33 mounted to the contour trough 5 at an anchor 31, which is in turn mounted on outer surface 44 of raised side wall 7. The strap 33 can be covered with a friction material such as VELCRO® brand hook and loop material and secured to a corresponding anchor on the raised side wall 9, not shown. Alternately, FIG. 6 shows the use of two straps 33, 35 which could be similarly anchored to their corresponding raised sides 9, 7, respectively. These straps, 33, 35 also may be covered with hook and loop material. The securing straps are thought to be particularly beneficial in the event that the infant sleeper is disturbed by an outside force such as an overly rambunctious pet.

The infant sleeper shown above can be readily lined with a washable, removable cover and a sanitary liner. The open configuration of the infant sleeper facilitates easy removal and cleaning of the liner. Furthermore, the liner can be made out of a water impervious material so as to avoid leaks. Such material construction further facilitates clean up and maintaining proper sanitary standards for the infant.

The placement of the raised side walls 7, 9 relative to the contour trough 5 serves to focus the retaining effect at the approximate center of gravity of the infant. Any side-to-side, rolling or twisting motion of the infant therefore does not produce a change in position. The infant is secured in its position while also being free to move at will.

The infant sleeper also facilitates a greater feeling of freedom. As described above, the head of the infant can be placed on the head piece 12 which, as shown, is open to the surroundings. The infant is thus free to view familiar surroundings at a constant position. Furthermore, if the infant is moved, the bed can be moved as well. Thus, the infant can have the security of his or own bed with its associated smell and feel, at any location.

Due in part to the inclination of the base 1, the head of the infant is maintained in a permanently elevated condition. This position reduces the stress placed on an infant lying on a side position. Further, the infant's brain stem is better aligned with the spinal cord. The combination of body and head position relieves internal stress on the infant's organs and, as such, could help to reduce factors which contribute to sudden-infant-death-syndrome.

The open structure of the infant sleeper in the region of the head piece 12 eliminates the need for the infant to rebreathe air. Hence, the inherent freshness of air combines with the open construction to alleviate conditions leading to the discomfort associated with claustrophobia. Furthermore, the infant can be covered with, for example, a blanket without covering his or her head. The elevated design of the infant sleeper also helps to align the breathing passages of the infant so as to facilitate breathing.

The foregoing design has been specifically intended to ameliorate, to the extent possible, factors leading to sudden-infant-death-syndrome. Although all of the causes of SIDS are not yet fully known, it is possible that the construction of the infant sleeper could materially contribute to a reduction in such occurrences.

The principles, preferred embodiments and modes of operation of the present invention have been set forth in the foregoing specification. The embodiment disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously thought of. Numerous variations and changes can be made to the foregoing illustrative embodiments without departing from the scope and spirit of the present invention as set forth in the appended claims.

What is claimed is:

1. An infant sleeper, comprising:

a contour trough having a support member with a trough head end and a trough foot end;

two parallel raised side walls contacting opposite sides of the support member, each raised side wall having a front end, a mid section, a back end, and an inner surface, and having a height sufficient to prevent an infant from readily rolling over, the height of the side walls in an area adjacent the front end being substantially lower than the height of the side walls in the area adjacent the back end, to thereby define an open area for the head of an infant supported on the infant sleeper; and a horizontal surface comprising the upper surface of the support member, the horizontal surface extending a first distance between each raised side wall and a second distance parallel to the raised side walls, the dimensions of the first distance being slightly greater than the lateral dimensions of the infant, and the second distance being greater than the length of the infant, the horizontal surface having a curvature that is negative between the raised side walls.

2. An infant sleeper as claimed in claim 1, wherein each raised side wall has a front end, a back end, a tapered portion, the tapered portion extending from the mid section toward the trough head end and progressively lowering towards the trough head end such that each back end of each raised side wall is higher in elevation than each front end.

3. An infant sleeper as claimed in claim 1, wherein the horizontal surface is inclined between the trough head end and trough foot end of the contour trough so that the end of the horizontal surface that is near the trough head end is higher than the end of the horizontal surface that is near the trough foot end.

4. An infant sleeper as claimed in claim 1, wherein each raised side wall has an integral construction.

5. An infant sleeper as claimed in claim 1, wherein the two raised side walls are integral with the support member.

6. An infant sleeper as claimed in claim 1, wherein the horizontal surface is integral with the inner surfaces of the two raised side walls.

7. An infant sleeper as claimed in claim 1, wherein the contour trough sits on a base.

8. An infant sleeper as claimed in claim 7, wherein the base is beveled so as to place the trough head end of the contour trough above the trough foot end.

9. An infant sleeper as claimed in claim 1, wherein the contour trough has an integral construction.

10. An infant sleeper as claimed in claim 1, further comprising at least one retaining strap capable of extending between the two parallel raised side walls.

11. An infant sleeper as claimed in claim 10, wherein the retaining strap is covered, at least in part, with an adhesive material.

* * * * *